US005796369A

United States Patent [19]

Henf

[11] Patent Number: 5,796,369

[45] Date of Patent: Aug. 18, 1998

[54] HIGH EFFICIENCY COMPACT ANTENNA ASSEMBLY

[76] Inventor: George Henf, 174 Chaloupe Terrace, Sebastian, Fla. 32958

[21] Appl. No.: 795,509

[22] Filed: Feb. 5, 1997

[51] Int. Cl.[6] ..... H01Q 9/00

[52] U.S. Cl. ..... 343/752; 343/830; 343/845

[58] Field of Search ..... 343/700 MS, 722, 343/752, 830, 846, 848, 845, 749, 750, 825, 829; H01Q 9/00, 1/32

[56] References Cited

U.S. PATENT DOCUMENTS

| | | | |
|---|---|---|---|
| 2,724,052 | 11/1955 | Boyer | 343/830 |
| 3,838,429 | 9/1974 | Reggia | 343/752 |
| 3,967,276 | 6/1976 | Goubau | 343/752 |
| 4,851,859 | 7/1989 | Rappaport | 343/846 |
| 5,181,044 | 1/1993 | Matsumoto et al. | 343/752 |

*Primary Examiner*—Hoanganh T. Le
*Assistant Examiner*—Tho Phan
*Attorney, Agent, or Firm*—Malloy & Malloy, P.A.

[57] ABSTRACT

A High Efficiency Compact Antenna Assembly for use as a vertical antenna, used for the radiation and reception of various band length signals. The antenna assembly includes an assembly such that operation of the antenna is as efficient as antennae of much greater height. The structure of the assembly preferably includes a large surface area housing atop a conductive mast and in spaced apart electrical communication with a substantially circular collector. Spanning from the outside wall of the vertical cylinder to the mast is a minimal turn inductor so that the inductor does not create a field that would interfere with the field from the mast of the antenna. A transmitter\receiver is in connection with the antenna assembly at the mast and the collector. The mast, minimal turn inductor, and vertical cylinder are in connection with each other, while the collector interacts electrically with each.

20 Claims, 1 Drawing Sheet

HIGH EFFICIENCY COMPACT ANTENNA ASSEMBLY

BACKGROUND OF THE INVENTION

1. Field of the Invention

The present invention relates to low and high frequency vertical antennas used for the radiation and reception of various band length signals. These antennas are typically used by private radio operators or amateur radio operators, or utilized in the transmission of commercial signals popularly known as AM and FM radio. The present invention utilizes a structure that significantly reduces the height of the antenna as compared to traditional vertical antennas which permits the user to utilize more ground space around the antenna and be less obtrusive of air space surrounding the antenna.

2. Description of the Related Art

Conventional low frequency and high frequency vertical antennas are typically operated at heights equivalent to ¼ of a wavelength and require a large number of ¼ wavelength conductors radially dispersed from the antenna on the ground in order to perform efficiently. Properly constructed, full size vertical antennae will operate at close to 100% efficiency. However, the proper construction leads to a very tall antenna, which is the type of antenna typically seen next to radio stations with many cable supports holding it in place. Moreover, a tall antenna must have lights at various heights, including at the top of the antenna unit to warn aircraft of the tall structure which is difficult for pilots to see while in flight. Furthermore, due to the desire to develop land surrounding these large antennae, or due to the presence of situations where there is a desire to place an antenna in an already developed area, the utilization of a full size vertical antenna is sometimes not practical or even possible. The surrounding ground area acts as a collector of the electric field, and in order to have optimal performance the ground area around the antenna must be substantially free from development.

In the past the need for a shorter antenna was addressed by adding an inductor coil between the top and bottom of the shortened antenna. The inductor coil takes the place of the "missing" section of antenna height. However, as the antenna becomes successively shorter, the inductor coil necessarily increases in size. The significance of an increase in the size of the inductor coil is that while it accommodates the reduced antenna height it in turn introduces a large coil loss that adversely affects the antenna's resistance. For example, a 50% height reduction decreases the antenna's radiation resistance 500% while the inductor adds coil resistive loss severely reducing antenna efficiency. A decrease in antenna efficiency reduces both radiation and reception efficiency or quality.

Still, it has been determined that the capture area, of an antenna is basically independent of its physical size. Accordingly, a shortened antenna is theoretically capable of performing as well as a full size antenna, if its radiation and reception efficiency can be maintained at or near 100%. Unfortunately, however, current antenna technology has been unable to provide a short antenna which performs as efficiently as a tall antenna. In particular, as the overall height of the antenna is reduced, and the size of the inductor coil is increased, the length of the antenna above the inductor coil shrinks dramatically and the ability of the electric field surrounding the antenna to increase to acceptable levels is compromised. The electric field that ultimately surrounds the antenna is significantly smaller in presently available short antenna as compared to its full size counterpart, the tall antenna, primarily because of coil losses.

The importance of the size of the surrounding electric field is directly related to the performance of the antenna. Simply put, a large surrounding electric field has significantly better performance qualities than a smaller surrounding electric field. Therefore, presently available short antenna, with smaller surrounding electric fields, suffer dramatically in both radiation and receptive performance quality.

It is well known in the art that electromagnetic radiation occurs as the result of the interaction of a magnetic field, H, and electric field, E. Specifically, when current flows in an antenna it creates a magnetic field, H, surrounding the conductor. At the same time, this flow of current establishes a voltage gradient which in turn creates an electric field, E. These two fields interact or "cross" each other creating electro-magnetic radiation. This action is, in the art, referred to as E×H and was established by Maxwell in the last century. It is also known that the electromagnetic radiation resulting from E×H will be proportional to the smaller of these two quantities that are inherently balanced.

As the vertical is shortened, its radiation resistance becomes smaller and the resultant antenna current in turn increases, thereby increasing the antenna magnetic field. However, as an even larger inductor coil is inserted, its loss lowers the potential voltage present above the coil and its corresponding E field. Further, the coil loss adds to the overall antenna resistance reducing the net antenna current. Both of the above factors result in a very inefficient antenna despite countless efforts that have been undertaken in attempts to increase efficiency, including attempts at techniques for reducing coil loss, but not eliminating it.

Accordingly, since the present technology only allows peak performance from tall antenna, persons seeking such performance must suffer the adverse side effects of operating a tall antenna. Of course, a tall antenna has large maintenance costs associated with the structure of the antenna itself, the securing of the antenna to the ground and the requirement that a tall antenna have lights, which must be changed, for air traffic safety. Many such concerns operate as barriers to both individuals and commercial users being able to obtain an antenna providing optimal performance which is short enough for practical use.

Accordingly, there is substantial need in the art for an antenna that is shorter than the present tall antenna and thereby facilitates operation where surrounding ground and or air space is a concern. There is also a substantial need to provide an antenna which is shorter in order to reduce the maintenance cost associated with tall antenna, such as maintaining the cables which secure a tall antenna to the ground and lighting the tall antenna so that aircraft may pass safely. Foremost, however, there is a need for a shorter antenna capable of generating a strong electric field that will maximize E×H interaction that results from the strong inductive magnetic field that is generated by the antenna current present in a short antenna.

SUMMARY OF THE INVENTION

The present invention is directed towards a High Efficiency Compact Antenna Assembly to be used by private radio and commercial radio operators who desire the performance of a tall vertical antenna but wish to utilize a shorter antenna without sacrificing efficiency. In the preferred embodiment, a 72 inch high Efficiency Compact Antenna Assembly will equal the performance of a typical 40 meter vertical dipole antenna 72 feet high.

Specifically, the high efficiency compact antenna assembly of the present invention includes an electric field generator with integral conductive support mast and a collector. The electric field generator, which is disposed in space, is in electrical communication with the collector. The electric field generator includes a conductive support mast and housing mechanically coupled to the support mast. In particular, the housing which preferably includes a generally cylindrical configuration is positioned in space above and apart from the collector so as to direct an electric field therefrom to the collector in a semi-circular path. Accordingly, a maximum of interaction i.e. "crossing" occurs between the electric field generator and the magnetic field surrounding the conductive support mast.

Moreover, the electric field generator preferably includes an inductor disposed in electrical communication between the housing and the mast. The inductor, which increases the electrical antenna length to the proper value, is positioned such that the magnetic field generated thereby is directed in such a manner that it will not cross with the electric field and distort the radiated signal.

A signal interpretation assembly is further provided and is disposed in electrical contact at a first point with the bottom of the conductive mast and at a second point with the inner surface of the collector.

It is an object of the present invention to provide an antenna that operates at the efficiency of a tall vertical antenna, but which is much shorter than the tall vertical antenna.

It is an additional object of the invention to provide an antenna that is physically very short (1/10 typical height) yet requires no inductor coil to achieve resonant operation.

It is also an object of the invention to provide an antenna that will facilitate functional use in areas where both ground space and or air space may be limited.

Another object of the invention is to provide an antenna where the maintenance cost to operate the antenna are relatively low as compared to an equally efficient tall vertical antenna.

Yet another object of the invention is to provide an antenna which is as efficient as a tall vertical antenna, but can be manufactured and installed quickly and at a fraction of the cost.

Still another object of the invention is to provide an antenna that is as efficient as a tall antenna, but sized in order that it may be moved from one sight to another without experiencing great cost.

An additional object of the invention is to provide an antenna which is as efficient as a tall vertical antenna and is dimensionally flexible unlike traditional antennas.

A further object of the invention is to provide an antenna which does not require extensive conventional ground radials, thereby dramatically reducing the conventionally large ground foot printing requirement by use of a small collector ring.

An ancillary object of this invention is to provide an antenna with adjustable capacitance which is capable of frequency agile radiation and reception.

An additional object of the present invention is to provide an antenna which provides a sufficient strength electric field for a variety of applications, and is configured to direct that electric field in such a manner as to maximize its "crossing" with the magnetic field generated by the short conductive vertical mast.

Yet another object of the present invention is to provide an antenna which creates the necessary electric field increase and that is configured such that the location of the magnetic field generated by the inductor and the positioning of the electric field are such that minimal "crossing" is achieved.

In accordance with these and other objects which will become apparent hereinafter, the instant invention will now be described with particular reference to the accompanying drawings.

BRIEF DESCRIPTION OF THE DRAWINGS

The invention may be better understood by reference to the drawing in which.

DETAILED DESCRIPTION OF THE PREFERRED EMBODIMENT

Figure 2:
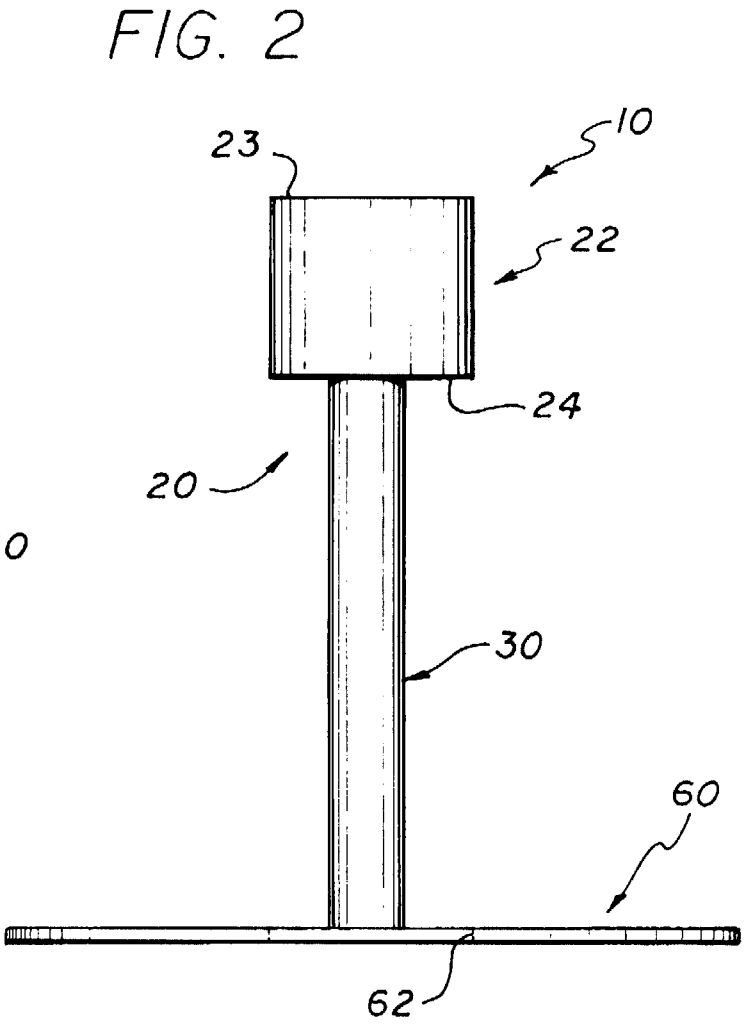
FIG. 2 is a side view of certain structural components to the embodiment of FIG. 1.
Figure 1:
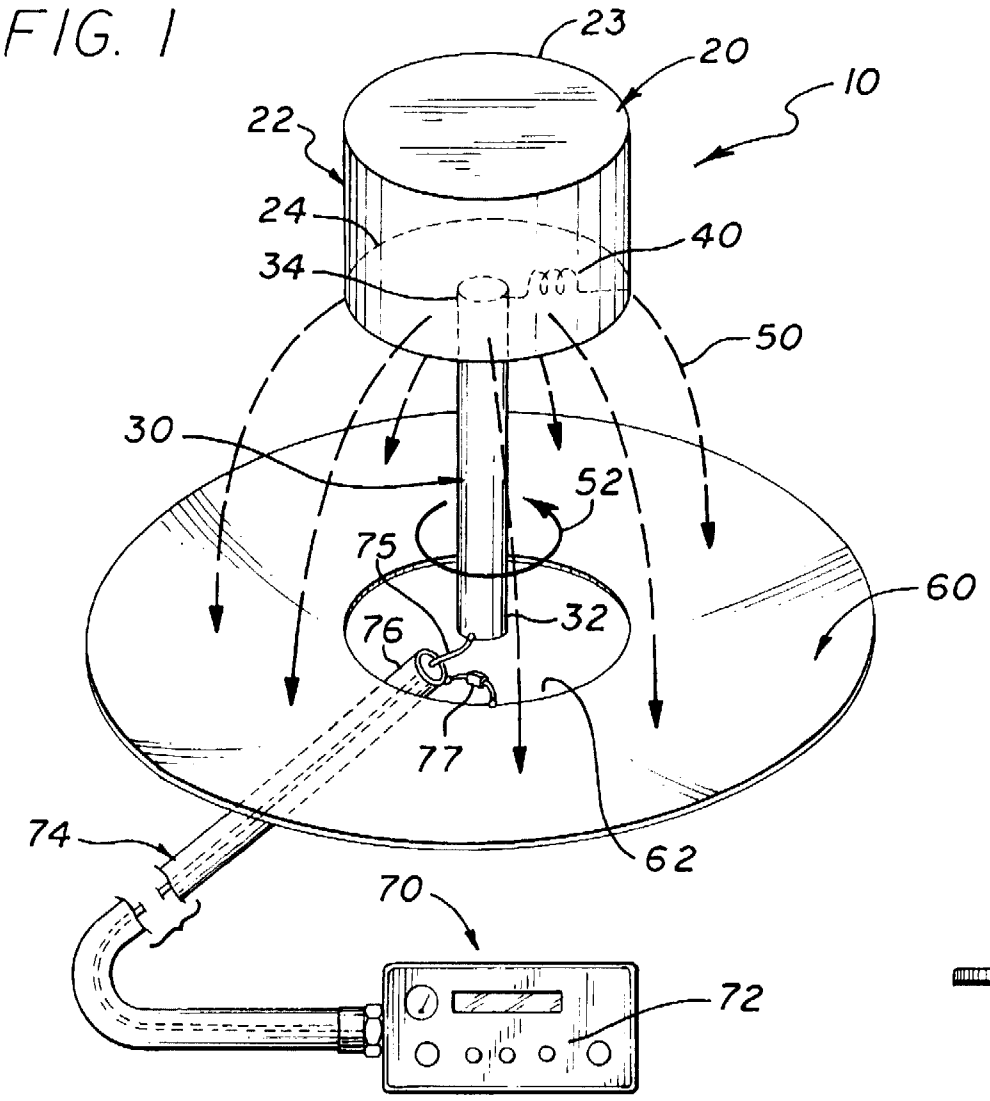
FIG. 1 illustrates a perspective view of the High Efficiency Compact Antenna Assembly.

The present invention is directed towards a High Efficiency Compact Antenna Assembly, generally indicated as 10, which exhibits a radical departure from the traditional short antenna. The High Efficiency Compact Antenna Assembly 10 is capable of efficient operation on the low and high frequency bands.

Looking to the Figure, the preferred embodiment of the antenna assembly 10 includes primarily an electric field generator, generally 20, and a collector 60. The generator 20 and collector 60 are disposed in spaced electrical communication with one another, as will be described in greater detail subsequently, and provide for the generation of an electric field therebetween.

In particular, the collector 60 preferably includes a substantially flat, substantially circular conductive plate preferably positioned a minimum of about 2 feet above ground level. It should be noted, however, that the collector 60 need not necessarily have a circular configuration, and therefore may include a square or alternative shape. The conductive material from which the collector 60 is formed, which may include any appropriate conductive material, functions to maintain the electric field with the generator 20, and indeed acts to draw the electric field thereto, in a uniform and properly spaced and disposed manner as will be described in greater detail subsequently. Moreover, the collector preferably includes a concentrically disposed opening 62 defined therein. The opening 62, which includes a determined dimension, such as a determined diameter in the case of a circular opening 62, is structured to force the generator 20 to maintain the spaced radial electrical communication, indicated graphically as 50. Indeed, the opening 62 maintains the spacing, but the close proximity between the generator 20 and the collector 60, as well as the strength of the electric field, force the electrical communication, illustrated as 50, to be maintained in a semi-circular path. Further, in a preferred embodiment, charging means are provided to supply a voltage to the collector 60 and mast 30.

Turning to the generator 20 of the present invention, it includes an upper member and a lower member which preferably define an overall height thereof. Preferably, the overall height of the generator 20, as defined by the upper member and lower member, is equivalent to a diameter of the generator 20. Specifically, the lower member of the generator 20 preferably includes a mast 30. The mast 30, which preferably includes an elongate cylindrical configuration, includes an upper end, 34, and a lower end, 32, with the lower end preferably disposed at the opening 62 of the collector 60. Moreover, the mast 30 is preferably axially aligned and concentrically perpendicular to the opening 62 of the collector 60.

Disposed preferably at the upper end of the mast 30, and preferably defining the upper member of the generator 20 is a larger surface area housing 22. The housing 22, which includes a first end 23, a second end 24, and a surrounding side wall to define its configuration, is preferably concentrically coupled to the mast 30 in an axially aligned orientation. Moreover, the housing 22, which also preferably includes a cylindrical configuration, includes a diameter significantly greater than that of the mast 30. Generally, the electric field 50 is established between the vertical surface of housing 22 of the generator 20 and the collector 60. As a result of the configuration and positioning of the housing 22 in a spaced apart electrical communication with the collector 60, the electric field 50 that is generated is drawn to the collector 60 spaced from the mast 30, and preferably spaced from a magnetic field 52 that is normally generated about the mast 30. As a result, appropriate crossing is maximized, and indeed, an effective radiated pattern between the housing 22 and the collector 60 is attained. In the preferred embodiment, a ratio of a height of the housing 22 of the generator relative to a height of the entire antenna 10 is between approximately 1:2 to 1:3. Moreover, a diameter of the housing 22 is preferably equivalent to a diameter of the opening 62 of the collector 60, and a height of the housing 22 is similarly equivalent to the diameter of the housing 22.

Additionally, in the typical embodiment, the generator 20 further includes an inductor 40. The inductor, which is not necessary in all instances, has a coiled configuration and functions to provide the proper phase to the electric field generated by the generator 20. Further, the inductor 40 of the present invention is preferably a zero turn to minimal turn inductor disposed in electrical communication between the mast 30 and the housing 22, and is aligned in an orientation that is substantially perpendicular to the mast 30. As such, the generation of a magnetic field that would interfere with the electric field being directed from the housing 22 to the collector 60 is avoided.

The antenna 10 of the present invention is supplied with radio frequency R.F. power via a 50 ohm coaxial transmission line 74. Specifically, the present invention further includes a signal interpretation assembly 70 disposed in electrical contact at a first point with the collector 60 and at a second point with the antenna mast 30. The preferred signal interpretation assembly 70 includes the coaxial cable 74 having a first cable end, a second cable end, a center wire 75, and a conductive shield 76 insulated from the center wire 75. The center wire 75 is preferably disposed in electrical communication with the mast 30 at the first cable end. Moreover, the mast 30 of the generator 20 preferably includes a contact point at its lower end connected with the center wire 75. Similarly, the conductive shield 76 is in electrical communication with the collector 60 at the first cable end. As illustrated, the connection with the collector 60 is preferably at the inner surface of collector 60. Also, in the preferred embodiment, the signal interpretation assembly 70 includes a transmitter/receiver unit 72, the coaxial cable 74 being connected to the transmitter/receiver unit 72 at its second cable end. Moreover, a variable capacitor 77 may be provided and disposed between the conductive shield 76 and the inner surface of collector 60 to vary the operating frequency of the invention.

Additionally, it should be noted that the collector 60 and housing 22, each of which are formed of a conductive material may include a mesh type configuration. Such a configuration is particularly effective to prevent snow and/or water build up thereon if adverse weather conditions are present.

A further description of the background and environment in which the high efficiency compact antenna assembly 10 of the present invention operates is warranted and will now be presented. Specifically, all antennas resonate when antenna inductive reactance, $X_L$, cancels antenna capacitive reactance $X_c$. The inductive reactance of the present invention is established by the short mast 30 and the inductor 40. The inductance created by the short mast 30, however, will be minimal since the mast 30 is very short compared to a ¼ wavelength. Unlike the present invention, conventional short antennas utilize a short rod or stinger that extends above an inductor. The stinger establishes the antenna's capacitance. That is, the capacitance is between this stinger and ground radials attached to the outer coaxial conductor of a feedline, and the capacitance that results is extremely small. It is established by the surface area of the stinger, which is typically 12 square inches e.g., |π×⅛ "dia.×36" length|. This very small area capacitor generates a very large capacitive reactance $X_c$, where $X_c$=

$$\frac{1}{2 \times \pi \times F \times C}.$$

where:

F is the frequency

C is the capacitance

To cancel this large capacitive reactance requires a very large inductor, of many turns, to develop a matching inductive reactance. An inductor with many turns, however, is inherently a high loss element. Physically short antennas have a very small radiation resistance. Radiation resistance is the equivalent resistance that reflects the antenna's radiated energy. Thus, even if a large diameter, well spaced, heavy wire coil is utilized, the large number of turns still create significant coil loss. This loss, when coupled with the very small antenna radiation resistance, creates an inefficient antenna because the power radiated is a function of the radiation resistance compared to the total resistance. The total resistance includes the loss resistance i.e., $$R_{total}=R_r+R_L$$

where:

$R_r$=radiation resistance $R_l$=loss resistance $R_{total}$=total resistance $$\text{Efficiency} = \frac{R_r}{R\,\text{total}}$$

The High Efficiency Compact Antenna Assembly 10 of the present invention discards entirely the small stinger of conventional short antennas and replaces it with a large surface area, vertically oriented, conductive, housing 22, the size of which is predicated on the system requirements. As such, the magnitude of the surface area of the housing 22 is not an absolute value. Based on radiated test data the housing 22 surface area is preferably guided by the equation: Housing area in square inches is equal to the product of the operating wavelength and the constant 60. For example, on a 20 meter operating wavelength the area is 20×60 or 1200 square inches and on an 80 meter wavelength it is 80×60 or 4800 square inches. Consequently, the preferred surface area for a 20 meter antenna is 1200 square inches. However, a conventional 20 meter antenna with a stinger is 100 times smaller in optimal surface area and cannot achieve the same results. As the operating frequency is lowered, the housing 22 area must be increased as noted above to maintain a fixed capacitive reactance, $X_c$. In the 20 meter example selected, increasing the area by 100 increases the capacitance by 100 times and reduces the capacitive reactance $X_c$ by 100. In turn, the inductive reactance $X_L$ needed to match the capacitive reactance $X_c$ is now reduced 100 fold. Inductance varies as a function of the number of coil turns squared i.e., $$\text{Inductance} = \frac{N_2 D_2}{18_D + 40_l}$$

where

N=number of turns

D=coil diameter

L=coil length

Reducing $X_L$ by 100 reduces the required turns by the square root of 100 or 10.

The High Efficiency Compact Antenna Assembly 10 has been able to reduce the size of the inductor 40 ten fold and most importantly the associated coil loss also ten fold thereby transforming the short antenna into an efficient radiator and receiver.

Reducing the required inductor 40 size also improves antenna usefulness by increasing its usable bandwidth. Antenna bandwidth is a direct function of its quality factor (Q). The lower the Q the wider the bandwidth. Q is a function of $X_L$ the inductive reactance e.g., ($X_L=2\times\pi\times F\times L$) divided by the total antenna resistance. Total resistance is the sum of the antenna radiation resistance and any loss resistances. Given no other changes, reducing the inductive reactance by 100 fold dramatically reduces the antenna Q and transforms the High Efficiency Compact Antenna Assembly 10 into a broadband antenna. The 100 fold transformation is not totally realized because when 1/10 the number of coil turns is required, the coil loss associated will be smaller and accordingly, $R_{total}$ will be smaller.

The electric field 50 created by housing 22 is of importance, however, it cannot occur by itself. The collector 60 establishes a companion surface between which the electric field 50 is developed. Moreover, the collector 60 is absolutely not a ground plane, although it might appear to be. It is the lower portion or terminus of a physically shortened vertical dipole. The collector 60 is preferably kept isolated from ground to avoid ground current coupling and associated loss. Further, the collector 60 will posses high voltage when the High Efficiency Compact Antenna Assembly 10 operates. Indeed, when installed, a protective assembly should be provided to assure that the collector 60 cannot be touched.

As indicated previously, the collector 60 is preferably a flat, circular or quasi-circular conductive surface whose inner diameter coincides with the diameter of housing 22 and whose outer radius is preferably nominally equal to the overall height of the antenna. This unique spatial configuration forces the electric field 50 that departs from housing 22 normal to its surface, to follow a semi-circular spatial path and impinge on the conductive surface of the collector 60. The center of the collector 60 is preferably removed to aid in forcing in the electric field (E) 50 to follow the desired semi circular path. Maxwell's equations state that the E×H action must occur with curved fields. If E×H were instead to occur in the same plane, radiation will not occur. E and H are spherical waves when they depart a point source, and they can only cross in the same plane when their spherical radius has become infinite. At infinite range, however, the signal at infinite range has become so small no signal exists. Compressing the antenna i.e., shortening it, requires circular pattern control of the electric field (E) 50 to match its curvature to that of the naturally curved magnetic field 52 that surrounds the mast 30. The Housing 22 and collector 60 achieve this task, and in so doing, the electric field 50 is concentrated and placed in the magnetic field 52 surrounding mast 30 in an optimal orientation.

Moreover, the preferred location of inductor 40 is not arbitrary. The High Efficiency Compact Antenna Assembly 10 preferably positions the inductor 40 between mast 30 and the housing 22, and by locating the inductor 40 in this manner, the current and its associated H field 52, on mast 30, is maintained in-phase with the electric field 50 at resonance. For example, when the inductor 40 was temporarily placed at the base of mast 30, the current on the mast 30 underwent a 90 degrees phase shift created by the inductor 40. Radiation efficiency tests established that the radiated intensity was 3 db less than when the inductor 40 was placed at the top of mast 30 thus making that the preferred configuration.

Also as indicated, the height of the housing 22 versus its diameter conforms to an approximate 1:1 ratio. That is, the height and diameter are nominally equal. Increasing the diameter requires an increase in the collector 60 size which is not attractive and defeats the purpose of saving ground space around the antenna. Increasing the height of the antenna requires more surface area because the distance from the collector 60 is increased which in turn reduces the net antenna capacitance. The 1:1 ratio appears optimum but is not the exact ratio and is not critical. Small deviations are readily permitted and accommodated by small changes to the inductor 40 value, for example. Also as indicated, the ratio of the height of housing 22 to the overall antenna height i.e., (mast 30 plus housing 22), is typically 1:1.5 to 1:3. This ratio was established based on radiated test data. If the High Efficiency Compact Antenna Assembly 10 were to have a very short mast 30, its magnetic field 52 would be small and the electric field 50 large because of the housing's 22 resulting close proximity to the collector 60.

Moreover, increasing mast 30 length increases the magnetic field 52 and begins to decrease the electric field 50 by reducing its proximity to the collector 60. At the optimum mast 30 height, the antenna transmitted signal will peak. At that point E and H fields will be equal. Remembering that in E×H interactions, the radiation is limited by the smaller quantity i.e., E or H. Therefore, when both are equal, antenna height is optimum. That occurs in the preferred range of 1:1.5 to 1:3 as stated above.

The input impedance when the antenna is resonated, is in the range of 6 ohms to 12 ohms. A simple 4:1 ratio provides a simple match for the antenna. The type of matching device is not relevant to the invention. Further, basic tuning of the antenna is accomplished by selecting proper number of the turns of inductor 40. The antenna may be "fine" tuned by placing a variable capacitor 77 between transmission line's 74, outer conductive shield 76, and the inner edge of the collector 60. Increasing the capacitance lowers the resonant frequency reducing the capacitance raises the frequency as would be expected. A switch and set of fixed capacitors will also accomplish antenna fine tuning.

The High Efficiency Compact Antenna Assembly 10 has been field tested against a number of full size vertical dipoles operating in the 40, 21, 20, 19 meter bands. In summary, the preferred embodiment 72 High Efficiency Compact Antenna Assembly 10 equalled the 40 meter dipole performance.

Furthermore, the High Efficiency Compact Antenna Assembly 10 has established the following performance features:

1) Full size radiation efficiency from a miniature antenna;

2) Low Q, broadband operation without the losses associated with traditional short antennas;

3) a physical height 1/20 to 1/40 of a wavelength 4) optimal E×H operation created by pattern shaping of the E field by the large surface area housing and free-standing.

5) Extensive conventional ground radials are not required reducing the ground footprint requirement so that a smaller collector replaces conventional radials.

6) The dimensional requirements for the antenna are flexible unlike traditional antennas.

7) Resonant operation can be achieved without an inductor 40 providing the ultimate in efficiency and a measured VSWR 2:1 bandwidth of 15%.

8) Resonance without an inductor occurred with a 48" E field generator and an overall height of 72". The resonant length of a conventional dipole is 562".

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A high efficiency compact antenna assembly comprising:

(a) an electric field generator comprising a lower member and an upper member, (b) said lower member including a mast having an elongated configuration terminating at an upper end and a lower end and said upper member of said generator being mounted on said upper end of said mast, (c) said upper member of said generator including a housing having a substantially cylindrical configuration including a first end and a second end and a substantially surrounding side wall spaced outwardly from said mast, (d) a collector disposed in spaced apart electrical communication with said generator and including a substantially circular and substantially flat conductive plate having a centrally, substantially concentrically disposed opening formed therein, (e) said mast being substantially axially aligned with said opening and extending perpendicularly outward therefrom, said side wall of said housing disposed in outwardly spaced perpendicular relation to said plate, and (f) said side wall of said housing structured and maintained a sufficient spaced distance from said plate and said opening therein to direct an electric field from said sidewall of said housing outwardly from said mast in a generally semicircular path to said plate.

2. A high efficiency compact antenna assembly as recited in claim 1 further including charging means structured and disposed to supply voltage to said collector.

3. A high efficiency compact antenna assembly as recited in claim 1 wherein said collector includes a diameter substantially equivalent to a height of said generator.

4. A high efficiency compact antenna assembly as recited in claim 1 wherein a ratio of a height of said upper member of said generator relative to a height of said generator is between approximately 1:1.5 to 1:3.

5. A high efficiency compact antenna assembly as recited in claim 1 wherein said lower end of said mast includes an electrical contact point structured and disposed to achieve said electrical contact between said generator and said signal interpretation assembly at said second point.

6. A high efficiency compact antenna assembly as recited in claim 1 wherein said diameter of said housing is substantially equivalent to a diameter of said opening of said collector.

7. A high efficiency compact antenna assembly as recited in claim 6 wherein a height of said housing of said generator is substantially equivalent to said diameter of said housing of said generator.

8. A high efficiency compact antenna assembly as recited in claim 1 wherein said signal interpretation assembly includes a coaxial cable having a first cable end, a second cable end, a center wire, and a conductive shield insulated from said center wire.

9. A high efficiency compact antenna assembly as recited in claim 8 wherein said center wire is in electrical communication with said generator at said first cable end.

10. A high efficiency compact antenna assembly as recited in claim 8 wherein said conductive shield is in electrical communication with said collector at said first cable end.

11. A high efficiency compact antenna assembly as recited in claim 10 wherein said signal interpretation assembly further includes a variable capacitor disposed between said conductive shield and said collector.

12. A high efficiency compact antenna assembly as recited in claim 10 wherein said signal interpretation assembly includes a transmitter/receiver unit, said coaxial cable being connected to said transmitter/receiver unit at said second cable end.

13. A high efficiency compact antenna assembly comprising:

(a) an electric field generator comprising a lower member and an upper member, (b) said lower member including a mast having an elongated configuration terminating at an upper end and a lower end, said upper member of said generator being mounted on said upper end of said mast, (c) said upper member of said generator including a housing having a substantially right circular cylindrical configuration including a first end and a second end and a sidewall spaced outwardly from said mast, (d) a collector disposed in spaced apart electric communication with said generator and including a substantially circular and substantially flat conductive plate having a centrally disposed opening formed therein, (e) said mast being substantially axially aligned with said opening and extending perpendicularly outward therefrom, said sidewall of said housing disposed in outwardly spaced perpendicular relation to said plate, (f) said sidewall of said housing structured and maintained a sufficient spaced distance from said plate and said opening therein to direct an electric field from said sidewall of said housing outwardly from said mast in a generally semicircular path to said plate, and (g) an inductor electrically interconnected between said housing and said mast and disposed in substantially perpendicular orientation to said mast so as to avoid generation of a magnetic field around said mast that would interfere with said electric field being directed from said sidewall of said housing to said plate of said collector.

14. A high efficiency compact antenna assembly as recited in claim 13 further including charging means structured and disposed to supply voltage to said collector.

15. A high efficiency compact antenna assembly as recited in claim 13 wherein said collector includes a diameter substantially equivalent to a length of said generator.

16. A high efficiency compact antenna assembly as recited in claim 13 wherein a ratio of a height of said housing of said generator relative to a height of said generator is between approximately 1:15 to 1:3.

17. A high efficiency compact antenna assembly as recited in claim 13 wherein a lower end of said mast includes an electrical contact point structured and disposed to achieve said electrical contact between said generator and said signal interpretation assembly at said second point.

18. A high efficiency compact antenna assembly as recited in claim 13 wherein said diameter of said housing is substantially equivalent to a diameter of said opening of said collector.

19. A high efficiency compact antenna assembly as recited in claim 13 wherein a height of said housing of said generator is substantially equivalent to said diameter of said housing of said generator.

20. A high efficiency compact antenna assembly as recited in claim 13 wherein said signal interpretation assembly includes a transmitter/receiver unit.

* * * * *